US006613193B2

(12) United States Patent
Wolkowicz et al.

(10) Patent No.: US 6,613,193 B2
(45) Date of Patent: Sep. 2, 2003

(54) METHOD FOR FORMING A NESTED ROLLED PAPER PRODUCT

(75) Inventors: Richard Wolkowicz, Cumming, GA (US); Mark Burazin, Oshkosh, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/237,408

(22) Filed: Sep. 9, 2002

(65) Prior Publication Data

US 2003/0066616 A1 Apr. 10, 2003

Related U.S. Application Data

(62) Division of application No. 09/702,707, filed on Oct. 31, 2000.

(51) Int. Cl.[7] ..... D21H 27/00
(52) U.S. Cl. ..... 162/109; 162/117; 162/123
(58) Field of Search ..... 162/109, 110, 162/117, 123, 130, 267; 428/179, 181, 906; 493/321, 403, 269, 299

(56) References Cited

U.S. PATENT DOCUMENTS

| | | | | | |
|---|---|---|---|---|---|
| 3,301,746 | A | | 1/1967 | Sanford | |
| 4,100,017 | A | * | 7/1978 | Flautt, Jr. | 162/111 |
| 4,181,068 | A | * | 1/1980 | Pollock | 493/321 |
| 4,529,480 | A | | 7/1985 | Trokhan | |
| 4,659,608 | A | | 4/1987 | Schulz | |
| 4,671,983 | A | | 6/1987 | Burt | |
| 4,803,032 | A | | 2/1989 | Schulz | |
| 5,048,589 | A | | 9/1991 | Cook et al. | |
| 5,093,068 | A | * | 3/1992 | Schulz | 264/284 |
| 5,118,554 | A | | 6/1992 | Chan et al. | |
| 5,129,988 | A | | 7/1992 | Farrington, Jr. | |
| 5,297,919 | A | * | 3/1994 | Reichental et al. | 414/349 |
| 5,336,373 | A | | 8/1994 | Scattolino et al. | |
| 5,399,412 | A | | 3/1995 | Sudall et al. | |
| 5,436,057 | A | | 7/1995 | Schulz | |
| 5,494,554 | A | | 2/1996 | Edwards et al. | |
| 5,510,001 | A | | 4/1996 | Hermans et al. | |
| 5,573,830 | A | | 11/1996 | Schulz | |
| 5,575,420 | A | * | 11/1996 | Whitnell | 229/104 |
| 5,591,305 | A | | 1/1997 | Cameron | |
| 5,591,309 | A | | 1/1997 | Rugowski et al. | |
| 5,597,639 | A | | 1/1997 | Schulz | |
| 5,620,776 | A | | 4/1997 | Schulz | |
| 5,656,132 | A | * | 8/1997 | Farrington et al. | 162/117 |
| 5,667,636 | A | | 9/1997 | Engel et al. | |
| 5,672,248 | A | | 9/1997 | Wendt et al. | |
| 5,817,213 | A | | 10/1998 | Ostermayer et al. | |
| 5,834,099 | A | * | 11/1998 | Steinhardt et al. | 428/198 |
| 5,846,380 | A | | 12/1998 | Phan et al. | |
| 5,851,353 | A | | 12/1998 | Fiscus et al. | |
| 5,874,156 | A | | 2/1999 | Schulz | |
| 5,897,745 | A | | 4/1999 | Ampulski et al. | |
| 5,902,669 | A | * | 5/1999 | Steinhardt et al. | 428/198 |
| 5,932,068 | A | | 8/1999 | Farrington, Jr. et al. | |
| 6,017,417 | A | | 1/2000 | Wendt et al. | |
| 6,077,590 | A | | 6/2000 | Archer et al. | |
| 6,261,666 | B1 | * | 7/2001 | Enderby et al. | 428/172 |
| 6,277,466 | B1 | * | 8/2001 | McNeil et al. | 428/154 |

FOREIGN PATENT DOCUMENTS

| | | |
|---|---|---|
| AU | 225560 | 6/1958 |
| AU | 3387957 | 6/1958 |
| IT | 728640 | 12/1966 |
| WO | WO 0020684 | 4/2000 |

OTHER PUBLICATIONS

International Search Report, May 24, 2002.

U.S. Patent Application entitled "Rolls of Tissue Sheets Having Improved Properties," 30 pages, 15 drawings, U.S. patent application Ser. No. 09/441,987, Filing Date Nov. 17, 1999; Inventor: Mark A. Burazin, et al.

U.S. patent application Ser. No. 09/129,814, Filing Date Aug. 6, 1998; Inventor: Mark A. Burazin, et al.

* cited by examiner

*Primary Examiner*—Jose A. Fortuna
(74) *Attorney, Agent, or Firm*—Dority & Manning, P.A.

(57) ABSTRACT

A nested rolled paper product is shown in which raised and depressed areas are formed in a sheet. The depressed areas may comprise square shapes, rounded shapes or other geometric shapes that are capable of aligning or nesting in registration when the sheet is rolled to form a reduced diameter rolled product. A high loft through air drying fabric is employed to imprint a high caliper pattern into the sheet in such a way as to nest raised portions, resulting in a more compact product having a minimized roll diameter. Grooves or channels in the sheet are capable of aligning as the sheet is rolled. The resulting rolled product may be toilet tissue, paper towels, or other similar paper products. The final rolled product achieves a minimum roll diameter for a fixed roll length.

16 Claims, 5 Drawing Sheets

LEGEND

ℓ = Capiler of Sheet from Forming Wire

C = Shaped Caliper

METHOD FOR FORMING A NESTED ROLLED PAPER PRODUCT

RELATED APPLICATIONS

The present application is a divisional of U.S. application Ser. No. 09/702,707, which was filed on Oct. 31, 2000.

BACKGROUND OF THE INVENTION

Paper products such as toilet tissue, paper towels and the like are typically rolled onto cores during manufacture for both consumer and commercial use. Many dispensers use rolled products, and the rolled format has proved very useful for such applications.

Consumers tend to prefer rolled paper products that are bulky, having a large roll diameter, but not necessarily having a long roll or sheet length. On the other hand, commercial users tend to prefer rolls having a long sheet length, but other properties such as roll diameter, bulk, and thickness of the roll is only a secondary consideration. This results because commercial customers attempt to reduce the incidence of "run out", in which the roll runs out prior to the time that a maintenance person is able to reload the dispensing roll.

It is therefore a goal of manufacturers to achieve a long roll length for commercial uses without sacrificing the bulky and desirable handfeel of the paper product. Typically, a sheet having a reduced caliper (i.e. reduced sheet thickness) results in a longer roll length, but does so at the expense of quality perception and bulk of the product.

A product and method of producing a product that results in a long roll (i.e. sheet) length, and a smaller roll diameter, without sacrificing sheet quality and handfeel is desirable. A towel or tissue that provides a thick feel for commercial customers, which still provides a long roll length, is very desirable.

SUMMARY OF THE INVENTION

In one aspect of the invention, a nested rolled paper product is provided, comprising an elongated sheet of rolled fibrous. Further, depressed areas are formed in the sheet of fibrous material, the depressed areas being made by drying the paper product on a drying fabric having raised and depressed portions. Typically, the depressed areas of the elongated sheet are adapted to form channels in the sheet. The channels align in registration when the elongated sheet is rolled, thereby forming a nested rolled paper product having a compact exterior rolled dimension, but a desirable bulky handfeel to consumers when the sheet is dispensed from the roll. The rolled product may include channels in the machine direction of the sheet. In many embodiments, the rolled product includes channels in the cross direction of the sheet. Depending upon the geometry employed, the rolled product may provide channels that are aligned in registration in both the machine and cross direction.

Some embodiments of the invention provide a rolled product in which the product comprises a multi-ply laminate. A two-ply laminate is commonly used, but laminates having three, four, or more plies are possible applications of the invention. The depressed areas are sometimes square shaped, but may be rectangular, oval, spherical, five-sided, six-sided, heptagonal, octagonal, or any other configuration that is capable of aligning in registration.

In one aspect of the invention, a method of making a compact rolled paper product is provided. In one method, a first step is to form an aqueous suspension comprising paper-making fibers. As a next step, the suspension is diluted to disperse paper-making fibers. The suspension of fibers is distributed on a forming wire and is dewatered to form a wet web. The wet web is transferred to a transfer wire which runs at a slower speed than the forming wire. Thus, the transfer step from the forming wire to the transfer wire imparts machine direction stretch into the sheet. The sheet is then transferred to the drying fabric. The drying fabric (or throughdrying fabric, sometimes called a "TAD" fabric) includes raised and depressed portions. The wet web is conformed to the topology of the drying fabric. The wet web is dried to form a sheet having a mirror image of the raised and depressed areas of the sheet, forming channels in the sheet. In general, the depressed areas are aligned in machine direction in its long dimension and a cross direction perpendicular to the machine direction. The sheet is then rolled to form a rolled paper product, and the channels align in registration when the sheet is in the rolled condition, thereby forming a nested rolled paper product having a compact exterior diameter.

In some applications of the invention, a paper product formed by the process described above is provided.

BRIEF DESCRIPTION OF THE DRAWINGS

A full and enabling disclosure of this invention, including the best mode shown to one of ordinary skill in the art, is set forth in this specification. The following Figures illustrate the invention.

DETAILED DESCRIPTION OF THE INVENTION

Figure 1:
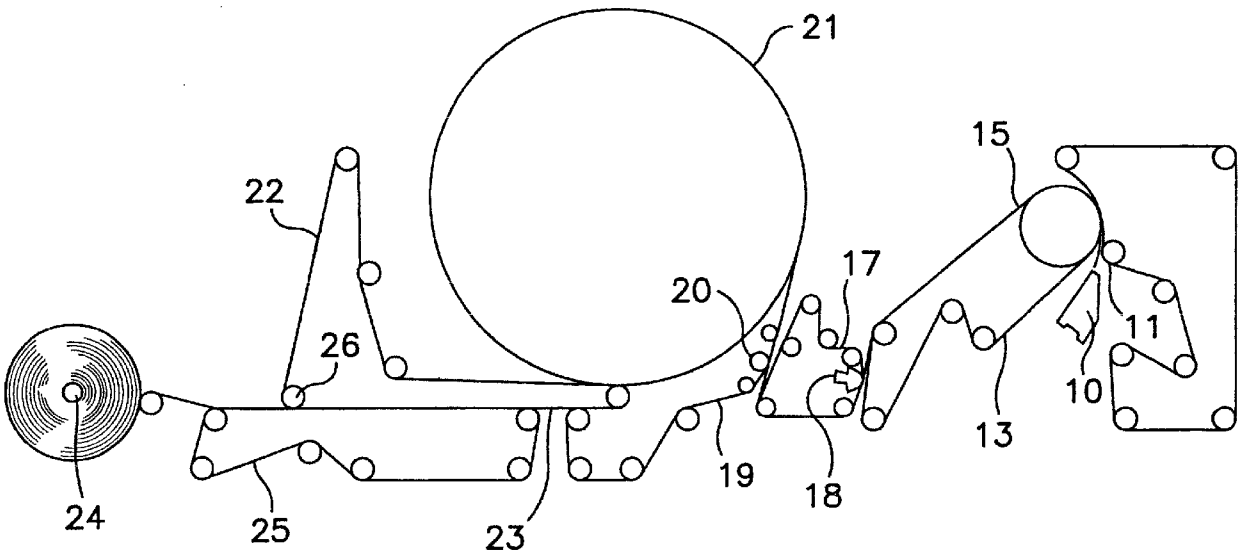
FIG. 1 is a schematic process flow diagram illustrating a method of making uncreped throughdried sheets having channels in accordance with the invention.

Reference now will be made to the embodiments of the invention, one or more examples of which are set forth below. Each example is provided by way of explanation of the invention, not as a limitation of the invention. In fact, it will be apparent to those skilled in the art that various modifications and variations can be made in this invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features and aspects of the present invention are disclosed in or are obvious from the following detailed description. It is to be understood by one of ordinary skill in the art that the present discussion is a description of exemplary embodiments only, and is not intended as limiting the broader aspects of the present invention, which broader aspects are embodied in the exemplary constructions.

In one aspect of the invention, a towel is made with a high loft through air dry (TAD) fabric that imprints a high caliper pattern into the sheet. The pattern is formed by the drying of the wet web as it is pressed into a sheet during manufacture of the product. In many applications, a product manufactured in this way will cause the consumer or user of this product to believe that he has a thick towel regardless of the basis weight of the towel. The TAD fabric design is one that causes the plies or layers of the towel to nest or register on top of each when the paper is rolled upon itself into a finished product. In this manner, a large footage of towel may be wound upon a single roll. In one fabric pattern, it is possible to create uniform longitudinal channels in the paper sheet so that the sheets nest or register together as they are wound upon a core. The amount of footage or length of the sheet on the roll may be further increased by using a calender roll with the same channeled pattern as that of the paper sheet to compress the paper in such a way that the thickness is reduced between the plies. However, in such a product the caliper measured from peak to peak of the channels is maintained.

In some applications, TAD fabrics are designed so that the paper sheet formed upon them will have a high caliper as the paper is molded to the topography of the fabric using vacuum pressure, air pressure, or a rubber nip roll. The TAD fabric must be designed so that the paper sheet nests as it winds upon a roll. There are many designs possible and various geometries and sizes of depressed portions upon the fabric, with the respective depressed areas on the paper product are possible. For example, one relatively simple design is to provide a TAD fabric which produces uniform longitudinal channels that will nest as they are wound upon a roll. If one looks at the towel or paper product in cross-section transverse to the channels, the pattern is seen as a sine wave.

There are numerous designs that are capable of nesting. For example, a fabric may be designed to create pockets in the paper which nest into one another such as egg cartons would nest into each other if they were stacked. In this manner, it is possible to use a minimum basis weight, and still maximize the length of a high caliper towel on a roll of a given diameter.

In general, one objective of the invention is to produce a relatively high caliper paper product, one which still denotes quality and a superior handfeel to the user. In general, high bulk sheets are preferred in toilet tissue and paper towel products because they provide a feeling of substance to the product for most consumers. It is possible to obtain a high bulk sheet by embossing a sheet after it is dry. However, one disadvantage of embossing a sheet is that embossing generally compresses the sheet and often weakens the sheet, which is detrimental.

To the contrary, a sheet which is shaped with using the TAD fabric is non-compressively dried and gives shaped caliper to the base sheet without increasing the density of the sheet. Shaped Caliper is the caliper of a single sheet measured from the peaks on top surface of the sheet to peaks on the bottom. Shaped caliper is generated as base sheet dries following the contours of the TAD fabric. The density of the sheet remains constant as it non-compressively dries. Caliper will be more completely described below in connection with FIG. 7.

Surprisingly, however, in this invention it has been discovered that if geometric patterns or shapes are provided on the surface of the sheet in a predetermined arrangement, it is possible to actually increase the length of paper that may be placed upon a roll of a given diameter. That is, by employing the invention, it is possible to use the shaping by the TAD fabric in the manufacture of the paper roll to produce a high caliper product without increasing the sheet density structure of a sheet. For example, it is possible to obtain the same length of sheet on a roll with a shaped caliper (16 to 30 mils) when the pattern is nested on the roll, as compared to a lower caliper web (8 to 12 mils) that is shaped but will not nest, both sheets having the same the same web density on the forming wire. That is, the channels or valleys of the sheet nest with each other, and the hills or raised portions of the sheet also nest with each other, when the sheet is wound upon a roll. Generally, in the manufacture of tissue products, such as bath tissue, a wide variety of product characteristics must be given attention in order to provide a final product with the appropriate blend of attributes suitable for the intended purpose of the product. Among these various attributes are improving the softness of the product, which always has been a major objective for premium products. Major components of softness include stiffness and bulk (caliper), with lower stiffness and higher bulk generally improving the perceived softness of the product.

Traditionally, tissue products have been manufactured using a wet pressing process in which a significant amount of water is removed from a wet laid web by pressing or squeezing water from the web prior to final drying. In particular, while supported by an absorbent papermaking felt, the web is squeezed between the felt and the surface of a rotating heated cylinder (Yankee dryer) using a pressure roll as the web is transferred to the surface of the Yankee dryer for final drying. The dried web is thereafter dislodged from the Yankee dryer by creping, which serves to partially debond the dried web by breaking many of the bonds previously formed during the wet pressing stages of the process. Creping generally improves the softness of the web, although at the expense of a significant loss in strength of the final product.

Recently, through air drying (TAD) has become a more prevalent means of drying tissue webs. Through air drying provides a relatively non-compressive method of removing water from the web by passing hot air through the web until it is dry. Specifically, a wet laid web is transferred from the forming fabric to a coarse, highly permeable TAD fabric and retained on the TAD fabric until it is dry. The resulting dried web is softer and bulkier than a wet pressed uncreped dried sheet because fewer paper making bonds are formed and because the web is less dense. Squeezing water from the wet web is eliminated, although subsequent transfer of the web to a Yankee dryer for creping is still used to final dry and/or soften the resulting tissue.

In general, the products of this invention may be single ply products or multi-ply products, such as two-ply, three-ply, four-ply, or greater. One ply products are sometimes advantageous because of their lower cost of manufacture, while multi-ply products are preferred by many consumers. For multi-ply products it is not necessary that all plies of the product be the same, provided at least one ply is in accordance with the invention.

Papermaking fibers useful for purposes of this invention include any cellulosic fibers known to be useful for making paper, particularly those fibers useful for making relatively low density papers such as facial tissue, bath tissue, paper towels, dinner napkins and the like. Suitable fibers include virgin softwood and hardwood fibers, as well as secondary or recycled cellulosic fibers, and mixtures thereof. Especially suitable hardwood fibers include eucalyptus and maple fibers. As used herein, "secondary fiber" means any cellulosic fiber which has previously been isolated from its original matrix via physical, chemical or mechanical means and, further, has been formed into a fiber web, dried to a moisture content of about 10 weight percent or less and subsequently reisolated from its web matrix by some physical, chemical or mechanical means.

A key component in tissue softness is sheet stiffness or resistance to folding. Previous processes decrease stiffness via creping, layering, patterned attachment to the Yankee dryer or some combination of these. Neither the first nor last process is possible in an uncreped throughdried process. Therefore, layering is expected to play a key role in reducing sheet stiffness at the required overall tensile strength. Ideally, the desired overall strength would be carried in a very thin layer (for low stiffness) which has been treated to give very high strength or modulus (perhaps by refining or chemical action). The remaining layer(s) would comprise fibers which have been treated to significantly reduce their strength (modulus). The key to achieving low stiffness at required overall strength is related to treating or modifying the fibers in such a way as to maximize the difference in strength (modulus) of the layers. An ideal modification for the weaker layer would simultaneously reduce tensile strength and increase bulk, as this would decrease modulus to the greatest extent.

Referring now to the tissue making process of this invention, the forming process can be conventional as is well known in the papermaking industry. Such formation processes include Fourdrinier, roof formers (such as suction breast roll), and gap formers (such as twin wire formers, crescent formers), etc. A twin wire former is preferred for higher speed operation. Headboxes used to deposit the fibers onto the forming fabric can be layered or non-layered, although layered headboxes are advantageous because the properties of the tissue can be finely tuned by altering the composition of the various layers.

More specifically, for a single-ply product it is preferred to provide a three-layered tissue having dispersed fibers on both the "air side" refers to the side for the tissue not in contact with the fabric during drying, while the "fabric side" refers to the opposite side of the tissue which is in contact with the throughdryer fabric during drying. The center of the tissue preferably comprises ordinary softwood fibers or secondary fibers, which have not been dispersed, to impart sufficient strength to the tissue. However, it is within the scope of this invention to include dispersed fibers in all layers. For a two-ply product, it is preferred to provide dispersed fibers on the fabric side of the tissue sheet and ply the two tissue sheets together such that the dispersed fiber layers become the outwardly facing surfaces of the product. Nevertheless, the dispersed fibers (virgin fibers or secondary fibers) may be present in any or all layers depending upon the sheet properties desired. In all cases the presence of dispersed fibers can increase bulk and lower stiffness. The amount of dispersed fibers in any layer can be any amount from 1 to 100 weight percent, more specifically about 20 weight percent or greater, about 50 weight percent or greater, or about 80 weight percent or greater. It is preferred that the dispersed fibers be treated with a debonder as herein described to further enhance bulk and lower stiffness.

In manufacturing the tissues of the invention, one embodiment is to include a transfer fabric to improve the smoothness of the sheet and/or impart sufficient stretch. As used herein, "transfer fabric" is a fabric positioned between the forming section and the drying section of the web manufacturing process.

An alternate embodiment of the invention would eliminate the transfer fabric and directly transfer the fibrous web from the forming fabric to the through air dry fabric. Other embodiments are possible as well.

Transfer fabrics include single-layer, multi-layer or composite permeable structures. Preferred fabrics have at least one of the following characteristics: (1) On the side of the transfer fabric that is in contact with the wet web (the top side) ,the number of machine direction is (MD) strands per inch (mesh) is from about 10 to about 200 (4 to 80 per centimeter) and the number of cross-machine direction (CD) strands per inch (count) is also from about 10 to about 200. The strand diameter is typically smaller than 0.050 inch (1.3 millimeter); and (2) on the top side, the distance between the highest point of the MD knuckle and the highest point of the CD knuckle is from abut 0.001 to about 0.02 or 0.03 inch (0.025 to about 0.5 or 0.75 millimeter). In between these two levels, there can be knuckles formed either by MD or CD strands that give the topography a three-dimensional characteristic.

To provide stretch to the tissue, a speed differential is provided between fabrics at one or more points of transfer of the wet web. The speed difference between the forming fabric and the transfer fabric may be from about 5 to about 75 percent or greater, preferably from about 10 to about 35 percent, and more preferably from about 15 to about 25 percent, based on the speed of the slower transfer fabric. The optimum speed differential will depend upon a variety of factors, including the particular type of product being made. As previously mentioned, the increase in stretch imparted to the web is proportional to the speed differential. Although imparting stretch to the sheet is a preferred embodiment if this invention, this invention does not rely on stretch, and some applications of the invention may not impart additional stretch. All fabrics may be traveling at identical speeds.

The drying process may be any noncompressive drying method that tends to preserve the bulk or thickness of the wet web including, without limitation, throughdrying, infrared radiation, microwave drying, etc. Because of its commercial availability and practicality, throughdrying is well known and is a preferred means for noncompressively drying the web for purposes of this invention. The web is preferably dried to final dryness on the throughdrying fabric, without being pressed against the surface of a Yankee dryer, and without subsequent creping. This provides a product of relatively uniform density as compared to products made by a process in which the web was pressed against a Yankee while still wet and supported by the throughdrying fabric or by another fabric, or as compared to spot-bonded airlaid products. Although the final product appearance and bulk are dominated by the throughdrying fabric design, the machine direction stretch in the web is primarily provided by the transfer fabric, thus giving the method of this invention greater process flexibility.

Turning now to FIG. 1, a means for carrying out the method of the invention is shown. For simplicity, the various tensioning rolls used to define the several fabric runs are shown but not numbered. It will be appreciated that variations from the apparatus and method illustrated in FIG. 1 can be made without departing from the scope of the invention. Shown is a twin wire former having a layered papermaking headbox 10 which injects or deposits a stream 11 of an aqueous suspension of papermaking fibers onto the forming fabric 13 which serves to support and carry the newly formed wet web downstream in the process as the web is partially dewatered to a consistency of about 10 dry weight percent. Additional dewatering of the wet web can be carried out, such as by vacuum suction, while the wet web is supported by the forming fabrics.

The wet web (sheet) is then transferred from the forming fabric to a transfer fabric 17 traveling at a slower speed than the forming fabric in order to impart increased machine direction stretch into the web. The sheet is transferred to the TAD fabric using a vacuum transfer which imparts a mirror image of the topology of the TAD fabric to the web. The web is dried on the TAD fabric, which sets the topology into the web. The TAD normally runs at the same speed as the transfer fabric, but can be run at a lower speed to impart additional machine direction stretch into the web. In one embodiment the topology of the TAD fabric comprises parallel hills and valleys evenly spaced in either the machine direction or perpendicular to the machine direction (i.e. the cross direction). The web takes the mirror image of the topology of the TAD fabric, thereby producing a web which also has hills and valleys. When the sheet is wound upon a roll and registration of the hills and valleys is maintained, the hills will nest into the valleys. This produces a nested rolled paper product having a compact exterior diameter.

Transfer is preferably carried out with the assistance of a vacuum shoe 18 and a fixed gap or space between the forming fabric and the transfer fabric or a kiss transfer to avoid compression of the wet web.

In one embodiment, the web is then transferred from the transfer fabric to the throughdrying fabric 19 with the aid of a vacuum transfer roll 20 or a vacuum transfer shoe, optionally again using a fixed gap transfer as previously described. The throughdrying fabric can be traveling at about the same sped or a different speed relative to the transfer fabric. If desired, the throughdrying fabric can be run at a slower speed to further enhance stretch. Transfer is preferably carried out with vacuum assistance to ensure deformation of the sheet to conform to the throughdrying fabric, thus yielding desired Bulk and appearance.

The pattern in the TAD fabric is normally created through the weave of the pattern. Hills and valleys may be created as the strands of filaments are woven into the fabric, and also by way of the use of varying the denier of filaments in the warp and shutes to create the desired pattern of hills and valleys. A TAD fabric can also be created by printing a polymeric coating with a desired pattern upon the surface of a carrier fabric and then crosslinking the polymeric coating to create a raised impervious pattern on the fabric. This can create valleys which are about 5 to about 125 mils deep.

For example, a noncompressed 42 gsm throughdried web with a density of 0.2 g/cc can be made that has a caliper of about 10 mils when the sheet is dried on a fine TAD fabric with small or closely spaced valleys. The caliper of this 0.2 g/cc can be increased to 20 to 50 mils by using a TAD fabric with 5 to 60 mil depressions which are not closely spaced (fabric meshes less than 50). In general, increasing the caliper will increase the diameter of the roll when the sheet length is maintained unless the fabric produces a nesting topography. The wire usually must be woven to provide depressions such as hills and valleys that are capable of registration to form a sheet that provides appropriate nesting of a multilayered product.

The level of vacuum used for the web transfer can be from about 3 to about 15 inches of mercury (75 to about 380 millimeters of mercury), preferably about 5 inches (125 millimeters) of mercury. The vacuum shoe (negative pressure) can be supplemented or replaced by the use of positive pressure from the opposite side of the web to blow the web onto the next fabric in addition to or as a replacement for sucking it onto the next fabric with vacuum. Also, a vacuum roll or rolls can be used to replace the vacuum shoe(s).

While supported by the throughdrying fabric, the web is dried to a consistency of about percent or greater by the throughdryer 21 and thereafter transferred to a carrier fabric 22. The dried base sheet 23 is transported to the reel 24 using carrier fabric 22 and an optional carrier fabric 25. An optional pressurized turning roll 26 can be used to facilitate transfer of the web from carrier fabric 22 to fabric 25.

Figure 2:
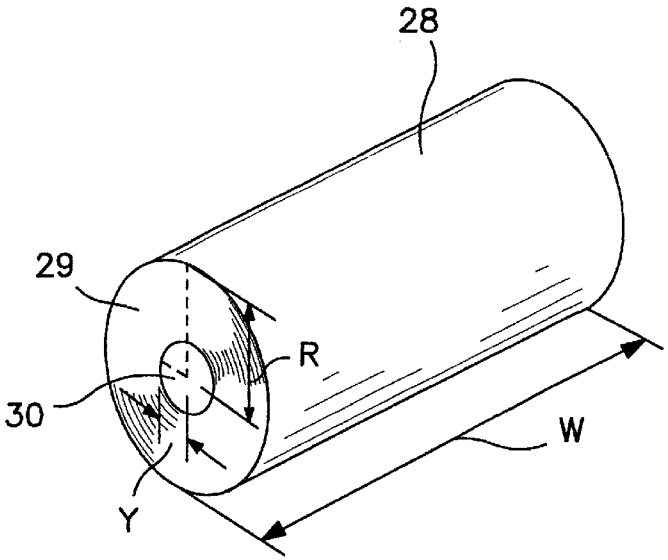
FIG. 2 shows a paper roll product produced using the method shown in FIG. 1.

FIG. 2 shows a typical rolled product produced according to the invention. A roll 28 is shown having a width designated as "W" on FIG. 2. Furthermore, a roll end 29 and a core 30 are shown. The core has a radius designated "r", and the radius of the roll is designated as "R".

Figure 3A:
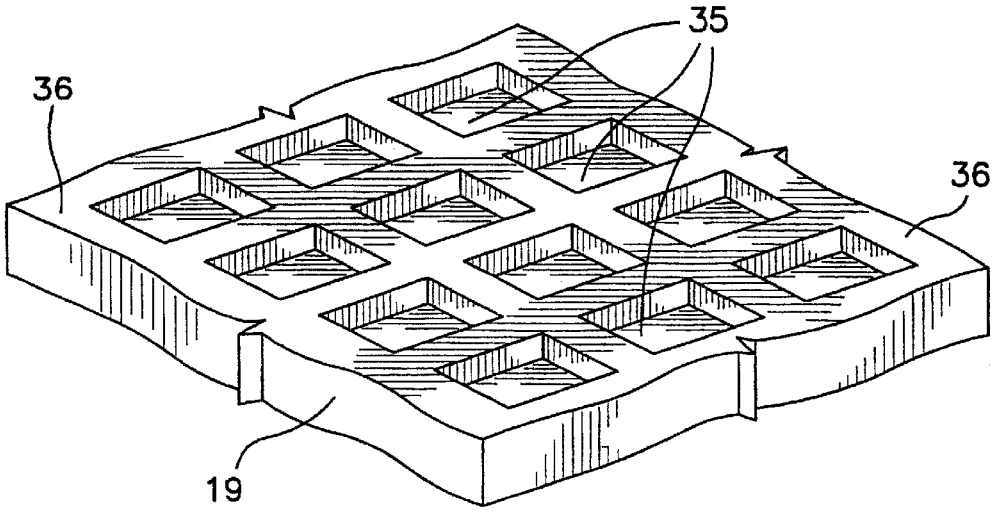
FIG. 3A depicts a cut away portion of a through drying fabric which has depressed portions in its upper surface.

In FIG. 3A, a cut-away portion of a through air drying ("TAD" fabric 19 is shown having depressed portions 35 on the top surface 36 of the TAD fabric.

Figure 3B:
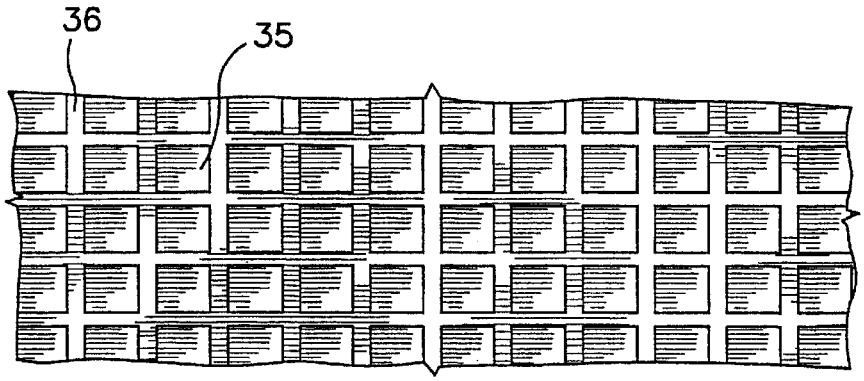
FIG. 3B shows a wider portion of a through drying fabric having square-shaped depressed portions across the fabric in the cross direction.

In FIG. 3B, a top view of the TAD fabric is shown clearly indicating the depressed portions 35 across the fabric. In FIG. 3B, the fabric is shown with the cross direction running left to right in the Figure. In general, the number of depressed portions across the fabric will depend upon the particular geometric pattern desired.

Figure 3C:
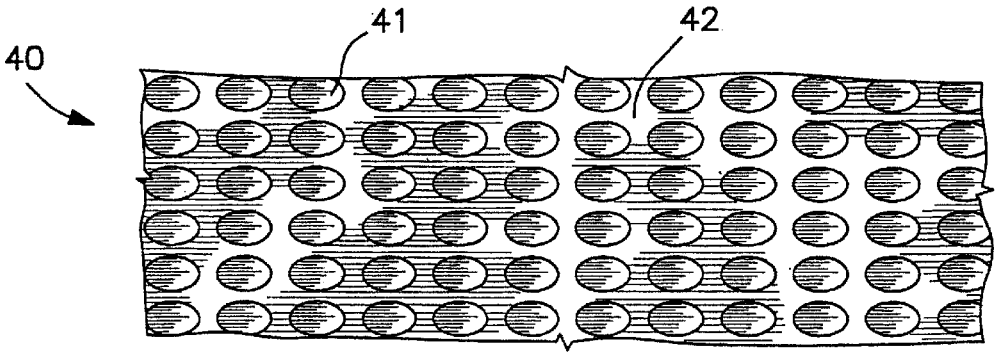
FIG. 3C shows a through drying fabric having elliptical oval shaped depressed portions.

FIG. 3C shows an alternate geometry of a TAD fabric 40 with depressed areas 41 shown as oval structures upon the surface of the fabric. Furthermore, a base 42 of the fabric is shown.

Figure 4A:
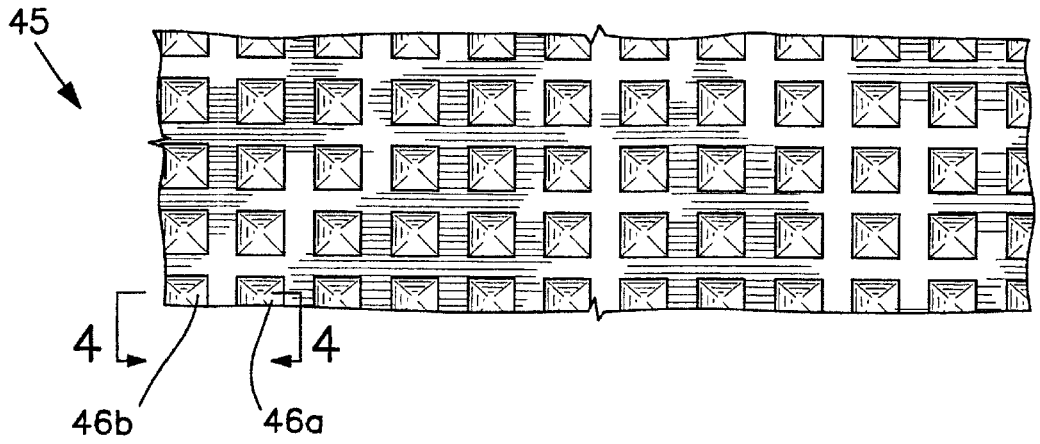
FIG. 4A shows a paper product manufactured on the drying fabric shown in FIG. 3B.

FIG. 4A shows a first paper web 45 that has been manufactured using the TAD fabric shown in FIG. 3B. In FIG. 4A, depressed areas are shown, such as for example depressed area 46*a* and depressed area 46*b*.

Figure 4B:
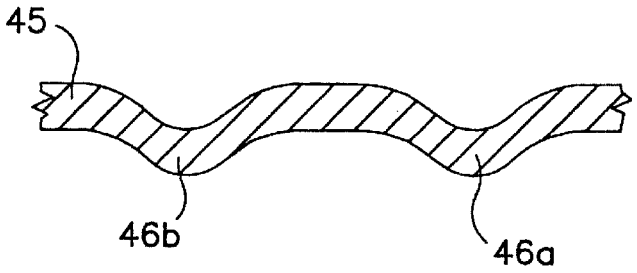
FIG. 4B is a cross sectional view of a portion of the paper product shown in FIG. 4A, taken along lines 4—4 of FIG. 4A.

FIG. 4B shows a cross section of the paper products shown in FIG. 4A in which a side view is taken of the cross-section along the lines 4—4 of FIG. 4A. In FIG. B, the depressed areas 46*a* and 46*b* are shown.

Figure 4C:
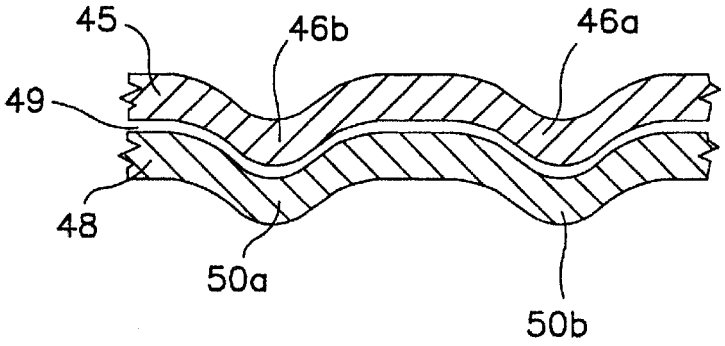
FIG. 4C is a similar cross sectional view of a multi-layered product.

FIG. 4C shows two nested layers of paper product having a first paper web 45 and a second paper web 48, with a space 49 in between. As seen in FIG. 4C, the depressed areas 46*a* and 46*b* of the first paper web 45 align in registration with the depressed areas 50*a* and 50*b* of second paper web 48 respectively.

Figure 5:
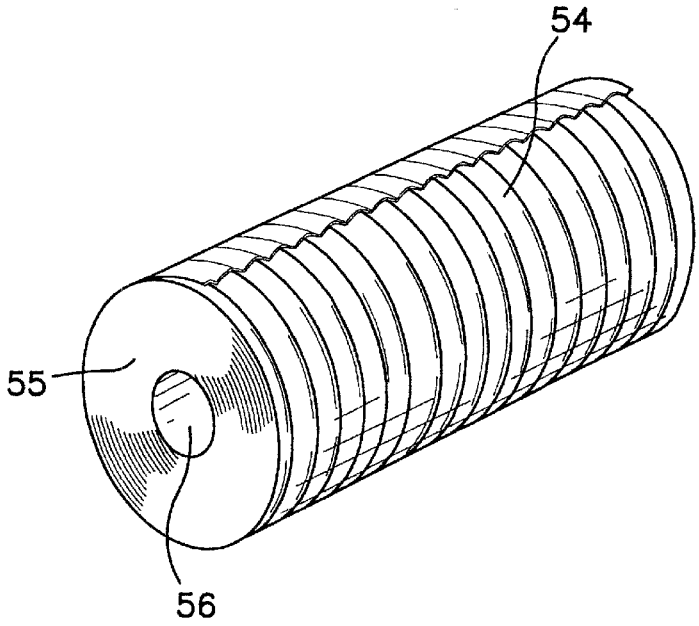
FIG. 5 is a perspective view of a compact roll product of the invention having channels in the machine direction.

FIG. 5 reveals one aspect of the invention in which channels 54 are provided in rows along the machine direction of the roll. A roll end 55 is shown on a core 56.

Figure 6:
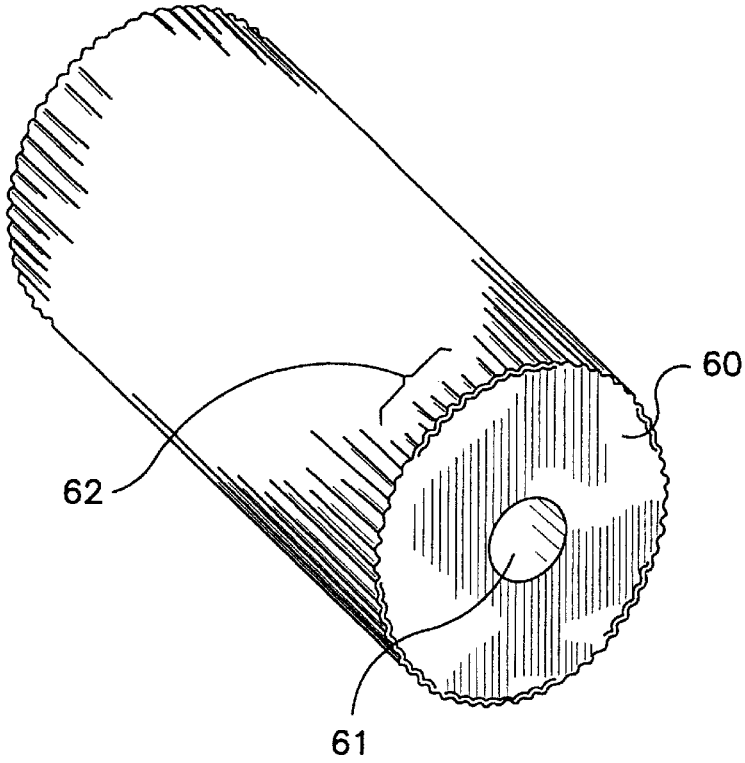
FIG. 6 is a perspective view of a compact roll product of the invention having channels in the cross direction.

FIG. 6 shows an alternative embodiment of the invention in which the channels are in the cross direction. In FIG. 6, the roll 60 has a core 61 about which is rolled a paper product which contains channels 62 in the cross direction of the sheet.

Figure 7:
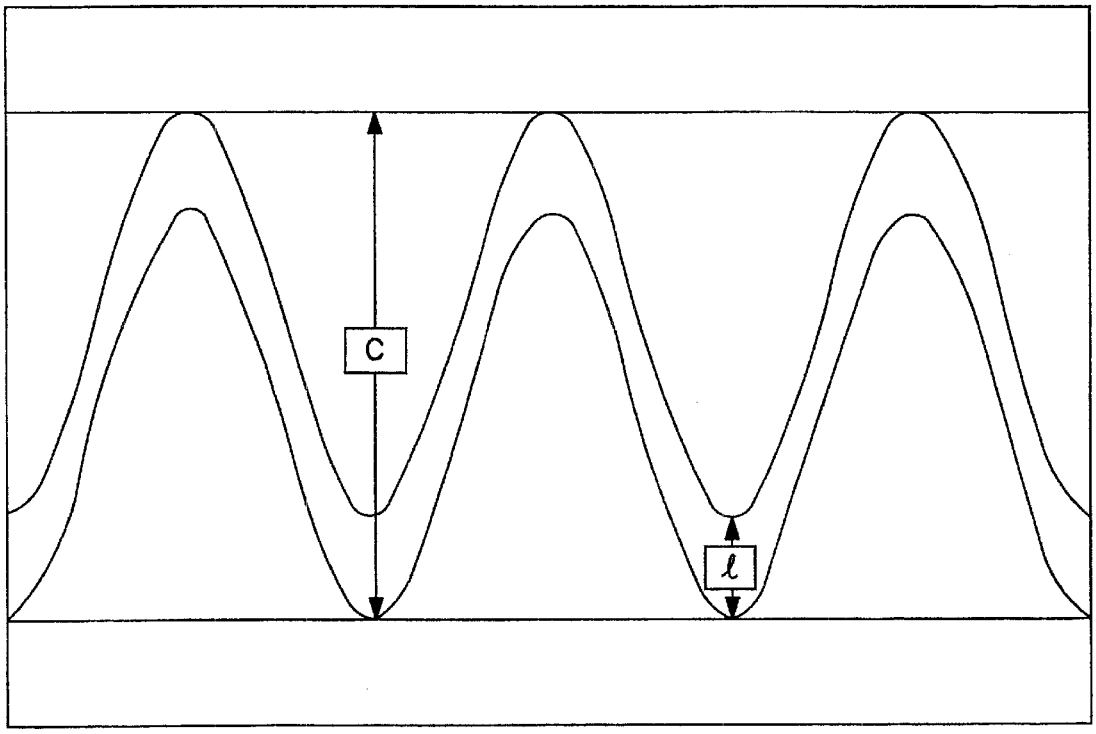
FIG. 7 shows how shaped caliper is measured.

FIG. 7 shows how caliper is measured for purposes of the invention.

The channels provided in the sheet may be in the machine direction, in the cross direction, or in some cases for certain geometric patterns the channels may be aligned and registered in both the machine and the cross direction. In some cases, the channels may be provided at an angle, in which the channels run not exactly in the machine direction or not in the cross direction, but instead at an angle. In many cases, the number of channels per inch will be between about 10 and 50 channels per inch. It is desirable not to provide too many channels per inch, and an excess of about 50 channels per inch probably may not provide sufficient nesting to achieve the advantages of the invention.

For paper products made pursuant to the invention, a typical towel roll will be about 8 inches in diameter and about 8 inches in width (i.e., W as shown in FIG. 2 will be about 8 inches). The core diameter may be about 1.5 inches in many applications.

In some applications of the invention, the shaped caliper of a 42 gsm will be from peak to peak will be about 30 mils. The unshaped caliper may be about 10 mils. It has been found that many different patterns may show some nesting capability. These patterns facilitate as much as ten to twenty percent more sheet on a roll for a given diameter.

As one example, a thirty mil thick sheet could be provided with an increased length from 144 feet to about 300 feet having the same 8 inch diameter with a nesting factor of 2.2 (see Example 4A, 4B below). In the application of the invention it is possible to create products and TAD fabric wires that create those products nesting between 50–100% of the theoretical nesting capability. That is, at one hundred percent nesting, the 30 mil shaped sheet with an unshaped sheet thickness of ten mils would have 404 feet on an 8 inch roll (see Example 6 below).

A nesting factor may be defined as the ratio of the volume of the sheet as it is observed off the roll compared to that on the roll.

The volume of the sheet off the roll=(sheet caliper)(roll length)(sheet width)=$c \times l \times w = V_s$ The volume of the sheet on the roll can be defined below:

$$V_r = w \times \pi \left( \frac{D^2}{4} - \frac{d^2}{4} \right)$$

Where, d=the diameter of the core; and

D=the diameter of the entire roll.

$$N.F. = \text{Nesting Factor} = \frac{V_s}{V_r}$$

In general, a completely non-nested roll will have $V_s = V_r$ and N.F.=1.0

To the contrary, a completely non-nested roll loosely wound will have $V_r$ greater than $V_s$ and N.F. will be less than 1.0.

In general, the higher the nesting factor (N.F.), the greater the degree of nesting upon the roll.

The caliper of the base sheet on the forming wire relies on the density of the sheet. If a 42 gsm sheet on the forming wire with a density of 0.2 g/cc were non-compressively dried, the caliper of the sheet could in some instances be about 8 mils ("l" in FIG. 7). This same sheet non-compressively dried on a TAD with substantial topography could have a shaped caliper ("c" in FIG. 7) more than 30 mils (2 to 5 times that on the forming wire) .

Caliper or bulk is the measurement of the thickness of one sheet of paper. It can be measured by conditioning the sample at 23+/−1° C. at 50+/−2% relative humidity for 24 hours and then measuring the thickness of the sample with a Emveco Model 200-A Microgage. The foot has a 56.42 mm diameter and loaded onto the sample at 2 kPa=/−2% at a lowering rate of 0.8 mm/sec. The dwell time on the sample is 3+/−1 seconds. This measures the thickness of the sheet from peak to peak under a pressure of 2 kPa.

The caliper of the sheet on the forming wire is related to the density of the sheet on the forming wire. A 42 gsm non-compressively dried sheet with a density of 0.2 g/cc would have a caliper of 8 mils if there were no shaping. When these sheets are dried on a TAD fabric shaped bulk or shaped caliper occur. A TAD fabric has peaks and valleys in its topography that will produce an increase in caliper. This results in "relatively high caliper" sheets with calipers 2–4 times that of the sheet on the forming wire result (in this example 16 to 32 mils) and in some cases TAD fabrics can produce "very high calipers" more than 4 times that of the sheet on the forming wire (32 or more mils).

Roll lengths are maximized by winding the rolls under tensile and also calendaring the towel sheet. This tends to produce towel which has lower caliper. The low caliper towel is considered by the user as a lower quality towel independent of its ability to dry hands.

In general, the inventions of this application include products having nesting factors that are greater than about 2.0, and more specifically, which are greater than about 2.5 in most instances. The invention further applies to products that have been throughdried using a TAD having a topography including channels and/or raised portions with depressions. In many instances, the products of this invention will exhibit a caliper that is greater than about 15 mils. Specifically, in many instances the range of caliper for products of this invention will be between about 15 and about 40 mils. employed is noncompressed and typically has a water capacity greater than about 4 grams of water per gram of fiber. Water capacity is measured as provided below.

In the application of the invention, the following water capacity test has been utilized.

Water Capacity Test

A sample 4" by 4" is cut with a die (obtained from Testing Machines Inc Amityville, N.Y. 11701) such that one side is parallel to the machine direction of the paper sample.

The sample is conditioned 24 hours at 23+/−1 degrees Centigrade and 50+/−2% relative humidity.

The sample is weighed to within 0.01 g and then place in distilled water at 23+/−2 degrees Centigrade for 3 minutes +/−5 seconds.

The samples is removed from the water and put in a frame that uses 3 bulldog clips (Hunt/Boston Bulldog clips: Office Product Catalog no. HUN02004) to hold three corners of the sheet such that it drains vertically along one of its diagonals.

The sheet is allowed to drain for 3 minutes +/−5 seconds.

The sample is released into a weighing dish and the weight of the sample and water is measured to 0.01 g.

Thee water capacity (g/g)={(Weight of wet sample)−(weight of dry sample)}/{Weight of dry sample}

The following are comparisons of commercial towels and their respective nesting factor(s) in Examples 1–4. Examples 5–7 provide various embodiments of the invention.

EXAMPLE 1

Prior Art

Kleenex® Brand 108 l=425 ft.=5100 inch w=8.0 inch
c=0.013 inch=13 mils
D=7.9 inch
d=1.5 inch $$V_r = \frac{D^2}{4} - \frac{d^2}{4} w = \frac{(7.9)^2}{4} - \frac{(1.5)^2}{4} \times 8 = 378 \text{ cu. in.}$$

$$V_s = c \times l \times w = .013 \times 5100 \times 8 = 530$$

$$N.F. = \frac{V_s}{V_r} = \frac{530}{378} = 1.40$$

EXAMPLE 2

Prior Art

Kleenex® Brand 104 l=800 ft.=9600 inch.
C=0.0087 inch
D=7.87 inch
d=1.5 inch
w=8.0 inch
$V_r$=375 cu. in.
$V_s$=c×l×w=0.0087×9600×8=668

$$N.F. = \frac{668}{375} = 1.78$$

EXAMPLE 3

Prior Art

Kleenex® Brand 1000

This roll is highly compressed.
l=1000 ft.=12000 inch
c=0.0078 inch=7.8 mils
D=7.87
D=1.5
W=8.0
$V_r$=375 cu. in.
$V_s$=749
N.F.=1.99
Further examples are shown below.

EXAMPLE 4A

Prior Art

BW=42 gsm
c=30 mils
l=135 ft.
D=8.0"
d=1.5"
w=8.0"
p density=0.2 g/cc.

$$N.F. = 1.0 = \frac{V_s}{V_r} = \frac{388}{388}$$

EXAMPLE 4B

Prior Art

24% Nesting

BW=42 gsm
c=30 mils
l=200 ft.
D=8.0
d=1.5"
w=8.0"
Density=0.2 g/cc $$N.F. = 1.49 = \frac{V_s}{V_r} = \frac{576}{388}$$

EXAMPLE 5

Invention

First Embodiment

61% Nesting

BW=42 gsm
c=30 mils
l=300 ft.
D=8"
d=1.5"
w=8"
Density=0.2 g/cc $$N.F. = 2.2 = \frac{V_s}{V_r} = \frac{864}{388}$$

EXAMPLE 6

Invention

Second Embodiment

Complete Nesting

BW=42 gsm
c=mils
l=404
D=8"
d=1.5"
w=8"
p=0.2 g/cc $$N.F. = 3.6 = \frac{V_s}{V_r} = \frac{1394}{388}$$

$$\text{Percent Nesting} = 100\% \frac{\text{Roll Length} - \text{Non Nested Roll Length}}{\text{Nested Roll length} - \text{Non Nested Length}}$$

EXAMPLE 7

Invention

Third Embodiment l=425 ft.=5100 inch
c=0.026 inch=26 mils
D=8.0 inch
d=1.5 inch
w=8.0 inch
Vr=378 cu. in.

$$Vs = c \times l \times w$$
$$= .026 \times 5100 \times 8$$
$$= 1060$$

N.F.=2.81

It is understood by one of ordinary skill in the art that the present discussion is a description of exemplary embodiments only, and is not intended as limiting the broader aspects of the present invention, which broader aspects are embodied in the exemplary constructions. The invention is shown by example in the appended claims.

What is claimed is:

1. A method of making a compact rolled paper product, comprising:

(a) providing a wet web of fibrous material to a drying fabric, the drying fabric having raised and depressed portions under conditions causing the wet web to conform to the drying fabric;

(b) drying the wet web to form a sheet having raised and depressed areas, the raised and depressed areas of the sheet forming channels in the sheet, the sheet having a machine direction in its long dimension and a cross direction perpendicular to the machine direction, whereby raised portions in the sheet are capable of registering with depressed portions on the sheet when aligned in a predetermined manner; and (c) rolling the sheet to form a rolled paper product; and (d) wherein the channels align in registration when the sheet is in the rolled condition, thereby forming a nested rolled paper product having a compact exterior diameter, wherein the nesting factor is greater than 2.

2. The method of claim 1, wherein a rush transfer step is performed on the wet web of fibrous material prior to step (a).

3. The method of claim 1, wherein the rolling step additionally comprises aligning raised areas with depressed areas in the sheet.

4. The method of claim 1, wherein prior to step (a), the following steps are performed:

forming an aqueous suspension of papermaking fibers;

dispersing the fibers in the aqueous suspension;

diluting the suspension;

feeding the suspension to a forming section; and dewatering the diluted suspension to form a wet web.

5. The method of claim 1, wherein the nesting factor is greater than about 2.5.

6. The method of claim 1, wherein the caliper of the elongated sheet is greater than about 15 mils.

7. The method of claim 1, wherein the caliper of the elongated sheet is from about 15 mils to about 40 mils.

8. The method of claim 1, wherein the product is non-compressively dried.

9. A method of making a compact rolled paper product, comprising:

(a) providing a wet web of fibrous material to a through-drying fabric, the throughdrying fabric having raised and depressed portions under conditions causing the wet web to conform to the throughdrying fabric;

(b) drying the wet web to form a sheet having raised and depressed areas, the raised and depressed areas of the sheet forming channels in the sheet, the sheet having a machine direction in its long dimension and a cross direction perpendicular to the machine direction, whereby raised portions in the sheet are capable of registering with depressed portions on the sheet when aligned in a predetermined manner; and (c) rolling the sheet to form a rolled paper product; and (d) wherein the channels align in registration when the sheet is in the rolled condition, thereby forming a nested rolled paper product having a compact exterior diameter, wherein the nesting factor is greater than 2 and the caliper of the elongated sheet is greater than about 15 mils.

10. The method of claim 9, wherein the nesting factor is greater than 2.5.

11. The method of claim 9, wherein the caliper of the elongated sheet is from about 15 mils to about 40 mils.

12. The method of claim 9, wherein the product is non-compressively dried.

13. The method of claim 9, wherein the rolled paper product comprises a multi-ply laminate.

14. A method of making a compact rolled paper product, comprising:

(a) providing a wet web of fibrous material to a through-drying fabric, the throughdrying fabric having raised and depressed portions under conditions causing the wet web to conform to the throughdrying fabric;

(b) drying the wet web to form a sheet having raised and depressed areas, the raised and depressed areas of the sheet forming channels in the sheet, the sheet having a machine direction in its long dimension and a cross direction perpendicular to the machine direction, whereby raised portions in the sheet are capable of registering with depressed portions on the sheet when aligned in a predetermined manner; and (c) rolling the sheet to form a rolled paper product; and (d) wherein the channels align in registration when the sheet is in the rolled condition, thereby forming a nested rolled paper product having a compact exterior diameter, wherein the nesting factor is greater than 2.5 and the caliper of the elongated sheet is from about 15 mils to about 40 mils.

15. The method of claim 14, wherein the product is non-compressively dried.

16. The method of claim 14, wherein the rolled paper product comprises a multi-ply laminate.

* * * * *